US008001954B2

(12) United States Patent
Boehner

(10) Patent No.: US 8,001,954 B2
(45) Date of Patent: Aug. 23, 2011

(54) DEVICE TO PITCH PRACTICE BALLS

(75) Inventor: Douglas L. Boehner, Truckee, CA (US)

(73) Assignee: Sports Attack, LLC, Verdi, CA (US)

( * ) Notice: Subject to any disclaimer, the term of this patent is extended or adjusted under 35 U.S.C. 154(b) by 906 days.

(21) Appl. No.: 10/256,040

(22) Filed: Sep. 25, 2002

(65) Prior Publication Data

US 2005/0166905 A1 Aug. 4, 2005

(51) Int. Cl.
*F41B 4/00* (2006.01)

(52) U.S. Cl. ..... 124/78

(58) Field of Classification Search ..... 124/6, 78
See application file for complete search history.

(56) References Cited

U.S. PATENT DOCUMENTS 3,306,613 A * 2/1967 Mainers ..... 473/436
3,724,437 A * 4/1973 Halstead ..... 124/78
4,352,348 A * 10/1982 Griffith ..... 124/78
4,372,284 A * 2/1983 Shannon et al. ..... 124/78
4,423,717 A * 1/1984 Kahelin ..... 124/78
4,442,823 A * 4/1984 Floyd et al. ..... 124/78
4,678,189 A * 7/1987 Koss ..... 473/436
4,841,945 A * 6/1989 Braden ..... 124/78
5,125,653 A * 6/1992 Kovacs et al. ..... 124/78
5,649,523 A * 7/1997 Scott ..... 124/78
5,865,161 A * 2/1999 Bruce ..... 124/78
6,089,217 A * 7/2000 Paulson et al. ..... 124/78

* cited by examiner

*Primary Examiner* — John Ricci
(74) *Attorney, Agent, or Firm* — John W. Crosby

(57) ABSTRACT

Practice balls may be presented to a person in need of hitting practice by using an apparatus for pitching practice balls that includes a support for a ball propelling head, high enough to raise the head to the approximate height of a pitcher's arm when he releases a pitched ball, three variable speed motor powered wheels forming a ball propelling chute to propel a ball dropped through the chute attached to the ball propelling head, the three wheels forming a chute through which the ball to be thrown is visible, and the three variable speed motor powered wheels attached to a motor plate held within and attached to a pivotable frame; a control panel attached to the support providing access to one speed control for each motor driving a ball propelling head; and at least one front wheel guard plate in front of at least one ball propelling head of sufficient strength to provide protection from pieces of the wheels if the at least one wheels should disintegrate. This invention further includes a method for pitching practice balls wherein the balls are delivered to a person in need of hitting practice balls that pass through a chute visible to one in front of the practice ball apparatus to a three-wheel motor driven ball propelling head forming supported by a frame that is pivotable to aim the ball.

17 Claims, 4 Drawing Sheets

DEVICE TO PITCH PRACTICE BALLS

BACKGROUND OF THE INVENTION

1. Field of the Invention

This invention relates to devices for practicing sports, and in particular, this invention relates to devices for simulating a pitched or thrown ball; and most particularly this invention relates to devices for simulating pitched baseballs and softballs.

2. State of the Art

Currently, there are many devices for simulating the throwing of a ball, in this dissuasion that usually means either baseballs or softballs, although cricket balls, and other pitched or thrown balls can be substituted, for players to practice with. Typically these devices have one or more wheels, two is typical, that engage the ball as it passes through the wheels and impart speed and spin to the ball. Naturally, devices containing two wheels are limited in orientation to one plane of motion are strictly limited in the amount of spin they can impart to the ball as it passes by.

One method to get more realistic spin on the ball is to drop it through a three wheel device. But these devices, even those with only two wheels in the propelling head, tend to have the severe draw back that they impede the practicing person's ability to see the ball as it is readied by the machine for pitching to that player. A player using one of these device is trying to prefect several things, one of them being his or her timing of the swing. Therefore, some indication that the ball is about to be pitched would be of great benefit to the practicing player.

Problems with the devices as they exist include the problem of the player not being able to see the ball until after it has been released. The actual acceleration of the ball and the mechanism of the ball's release are completely obscured in current designs. Players usually need the visual cue before the ball is released to move into position or generally prepare for the hitting of the balls. To simulate the speed of a thrown pitch, the balls are propelled at high speed, sometimes nearly one hundred miles an hour. this high speed creates as safety hazard if the balls vary from the course to the player. Specifically, if one of the balls hits someone, the damage can be heavy, therefore, it is essential that fragments from a disintegrating wheel or the like be prevented from hitting a player.

SUMMARY OF THE INVENTION

This invention provides an apparatus for throwing practice balls that may be presented to a person in need of hitting practice by using an apparatus for pitching practice balls including a support for a ball propelling head, the three variable speed motor powered wheels forming a ball propelling chute to propel a ball dropped down a chute attached to the ball propelling head, the three wheels forming a chute through which the ball to be thrown is visible, and the three variable speed motor powered wheels attached to a motor plate held within and attached to a pivot able frame; a control panel attached to the support providing access to one speed control for each motor driving a ball propelling head; and at least one front wheel guard plate in front of at least one ball propelling head of sufficient strength to provide protection from pieces of the wheels if the at least one wheels should disintegrate and to protect the wheel from the ball should a hit ball be driven directly back to the pitching apparatus. This invention also provides a method for pitching practice balls wherein the balls are delivered to a person in need of hitting practice balls that pass down a chute formed by a wedge formed by the top two of the three-wheel head. This chute is visible to one in front of the practice ball apparatus. The three-wheel motor driven ball propelling head is supported by a frame that is pivot able to aim the ball.

In one aspect of this invention is an apparatus for pitching practice balls comprising:

- a support for a holding ball propelling head some distance above the ground;
- a pivot able frame for the ball propelling head attached to the support;
- a mounting plate held by the pivot able frame;
- a three-wheel ball propelling head, the head having three wheels, the three wheels arranged to define a chute;
  - one motor for each of the three ball propelling heads, each motor attached to one of the wheels, and each motor mounted on the mounting plate; and
  - a ball presentation frame disposed in the chute on which a ball to be struck visibly passes before launch.

A second aspect of this invention is An apparatus for pitching practice of stick-hittable balls comprising:

- a support for a stick-hittable ball propelling head;
- a pivot able frame for the stick-hittable ball propelling head attached to the support;
- a ball propelling head including three variable speed motor powered wheels, the wheels each attached to a variable speed motor, the three wheels defining a chute through which chute the stick-hittable ball visibly passes before the stick-hittable ball is launched, such that the stick-hittable ball is visible to one standing in front of the apparatus, and the three variable speed motors attached to a motor plate held within and attached to the pivot able frame;
- a control panel attached proximate the motor plate providing access to one speed control for each motor driving a stick-hittable ball propelling head; and
- at least one rear wheel guard plate behind of at least one stick-hittable ball propelling head of sufficient strength to provide protection from pieces of the wheels if the at least one wheels should disintegrate.

A third aspect of this invention is a method for pitching practice balls comprising:

- delivering practice balls in a three wheels practice ball apparatus through a chute visible to a person standing in front of the practice ball apparatus to a three wheel motor driven ball propelling head supported by a frame that is pivot able to aim the ball; and
- launching the ball to the person standing in front of the apparatus for practicing hitting the launched ball.

DETAILED DESCRIPTION OF THE PREFERRED EMBODIMENT

Figure 1:
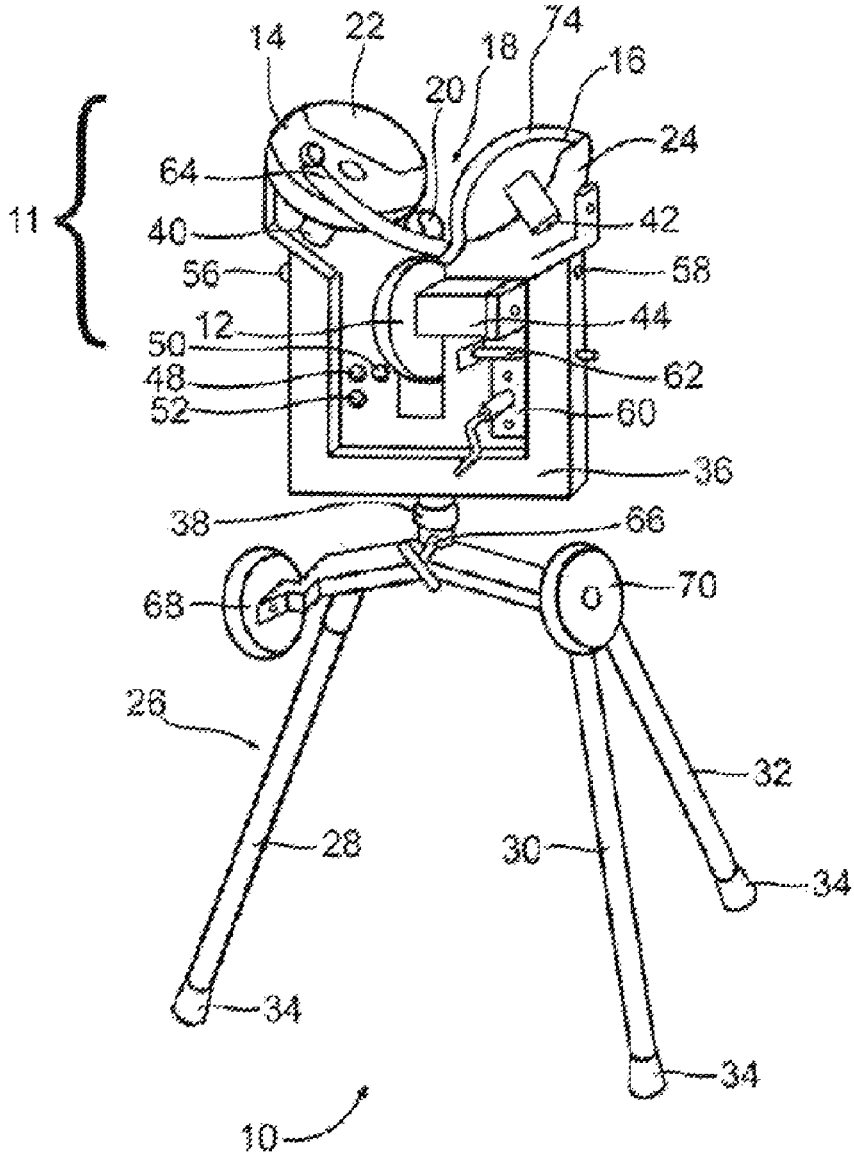
FIG. 1 shows a perspective rear view of the pitching apparatus of this invention.

Referring now to FIG. 1, the ball pitching apparatus 10 has a three-wheel ball propelling head 11 having three powered wheels 12, 14, and 16. These three wheels contact practice balls, launching them to the practicing player, who is standing in front of the apparatus about sixty feet away, while eliminating vision and spin problems. The two top wheels 14 and 16 form a chute 18 through which the ball 20 (for example) must pass before being propelled by the wheels. This chute allows the practicing player to see the ball before the apparatus launches the ball at the player. This visibility of the ball allows the batter to get a sense of when the ball is coming, allowing him or her to stride forward or whatever that player may do to prepare to hit a pitched ball. Since there are three wheels all one needs to do is change the relative spins of any of the wheels and the ball will spin in an infinite number of ways. Guard members 22, 24 and 25, shown in partial cutaway view to enable visibility of wheel 12 prevent the pieces that may result from fragments of a disintegrating wheel from hitting the operator in back of the apparatus and prevent the operator from accidentally touching a moving wheel while distracted by the practice. They also prevent the operator of the apparatus from inadvertently touching the rapidly rotating wheels. Such an occurrence might happen if the operator is watching the player during practice and not what he is doing with the apparatus. The wheels in the apparatus may be rotating as fast as 3000 RMP with eighteen inch wheels propelling a fast ball nearly 100 miles per hour. This is required in the operation of the apparatus since human pitchers are known to routinely pitch balls that fast.

While there are guard members in back of the apparatus, from the view of the person practicing, there are wheel guards in front of the apparatus. They wheel guards are thin metal strips bent around each of the wheels that protect the rapidly spinning wheels from direct hits from balls successfully hit by the practicing person. This happens fairly regularly, and the wheel guards protect the wheels from such impact and from the damage such impact would cause. In particular, they prevent the ball from damaging the wheel to the extent that it might disintegrate, thereby preventing wheels from casting pieces that might endanger those who might be standing near by.

A support for the ball propelling head includes a tripod formed of legs 28, 30, and 32 each having a rubber safety tip 34. The support allows for stability on uneven ground. It may also raise the ball propelling head 11 high enough to approximate the height of a pitcher's arm when he releases a pitched ball, although, given the variety of pitching styles and pitchers, this is a more difficult goal to achieve. A ball pitched from such a height will more accurately mimic a ball pitched by a human pitcher. The three wheels in the ball propelling head form a chute 18 through which the ball to be thrown is visible just before it is launched by the ball propelling head. The three heads supported by a frame 36 that is pivot able about a frame support pin to aim the ball. A motor 40, 42 and 44 propels each of the three wheels independently of the others. Varying the speed of the three wheels allows a second person, the operator, who is not the batter, but, perhaps a coach or another player, to provide a series of unknown to the player spins on the balls. The speed can be varied by the operator using the control box 46 having independent control knobs for each motor 48, 50, and 52 mounted on the support frame 36.

The motors are mounted on a motor plate 54, which is attached to the frame by pinions 56 and 58. An elevational control 60 allows the operator to adjust the angle relative to the ground the ball leaves the propelling head at. An elevational control allows the operator to control the angle of the throwing head with great precision in the strike zone to allow the player to be able to practice different pitches. A motor plate lock 62 receives the motor plate to the frame for easy and safe transportation of the pitching apparatus 10. The three variable speed motors are all mounted on the motor support plate which also forms a surface onto which the motors, the feed chute 62, the wheel guards 22 and 24 for example, and an elevation control 60. A horizontal control handle 66 mounted to a threaded means allows the motor plate to be secured to the frame before the device is transported, by locking the frame securely.

To prevent injury and allow safer use of high speed balls pitched from the machine, at least one front wheel guard plate 22 and 24 is placed in front of at least one ball propelling wheels 12, 14, and 16. The guard is of sufficient strength to provide protection from pieces of the wheel, and contain those pieces, if one of the wheels should, by misfortune, disintegrate. Of course it is usually preferred that there be a guard in front of each wheel.

The tripod legs allow best stability and transportability combination. They are attached to a ball propelling head mounting plate 72. A first transport wheel 68 and a second transport wheel 70 are attached to the head mounting plate 72, and allow easy transportation of the pitching apparatus 10. The two rear tripod legs 28 and 30 are preferably removable and when the apparatus is on its wheels it can be guided by using the front tripod leg 32 as a steering lever.

The three wheels preferably each include a cancave ball engaging surface to allow the maximum surface of the wheel to contact the ball as it passes the three wheels.

The three-wheeled head of propelling the propelling head configuration eliminates vision and spin problems. The arrangement of the wheels, that is, two on top and one on the bottom forms the chute 18 that allows the practicing player to view of the oncoming balls before they are launched by the apparatus. This is also a safety feature since batters are less likely to be inadvertently hit by a pitch since they can see if one is in the works The chute through which the ball must pass to get to the wheels allows the practicing player can see the ball before it is launched towards him. The visibility of the ball allows the batter to get a sense of when the ball is coming to stride forward or whatever that player may do in preparation for hitting a ball pitched towards him or her. Since there are three wheels all one needs to do is change the relative spins of any of the wheels and the ball will spin in an infinite number of ways.

While this invention has been described as being an apparatus for propelling balls, particularly stick-hittable balls. The preferred balls include, for example, softballs, handballs, tennis balls, cricket balls, baseballs, softballs (the baseballs, softballs, and cricket balls are specifically defined herein as the stick-hittable balls, and may be of slightly differing sizes and weights depending on the precise league and region of use) and the like can beneficially be used in the practice of this invention. The general key to the balls that would be beneficially used in this invention are those that are thrown to be struck or hit or the like by a player with a stick or glove or racket.

Figure 2:
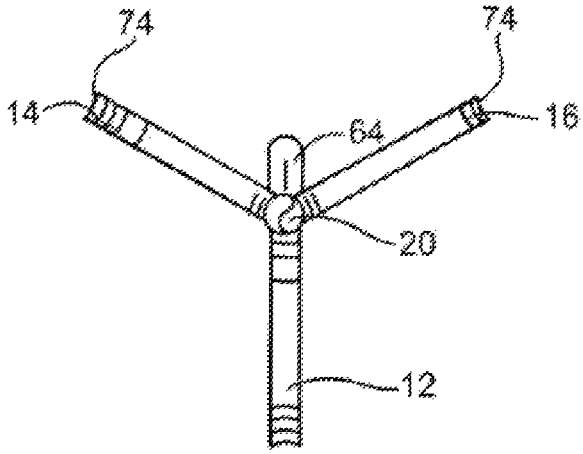
FIG. 2 shows a front schematic view of the ball propelling head of the apparatus shown in FIG. 1.
Figure 3:
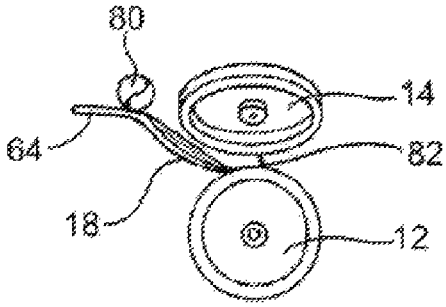
FIG. 3 shows a side schematic view of the ball propelling head of the apparatus shown in FIG. 1 and FIG. 2.

Referring to FIG. 2 and FIG. 3, the use of three wheels allows less wear on the balls used for practice than a configuration where only two wheels are used. When used in practice, this arrangement provides more speed and better accuracy, while providing a better gripping surface between the balls and the wheels. The surface is further improved by using a cancave surface for the contact surface 74 of the wheels.

This is important since the balls are being accelerated from zero to perhaps one hundred miles per hour in a fraction of a second. The chute 18 is shown as being defined by interstitial space between the two top wheels 14 and 16. The ball will always fall downwardly through the chute; therefore, the player will always have a view of the ball immediately before it is launched to him. Since the throwing head 11 (shown in FIG. 1) is mounted within a frame 36, it does not have to pivot. Instead the frame pivots itself. The ball 80 will roll down the chute 64 to the intersection of the three wheels 84.

The elevational control lever 60 allows the operator to control the height of the throwing head with great precision allowing the ball to be thrown anywhere in the strike zone to allow the player to be able to practice different pitches.

The horizontal control handle allows the frame to be secured before the device is transported, by locking the frame securely, thereby preventing it from movement that might accidentally hurt someone.

Figure 4:
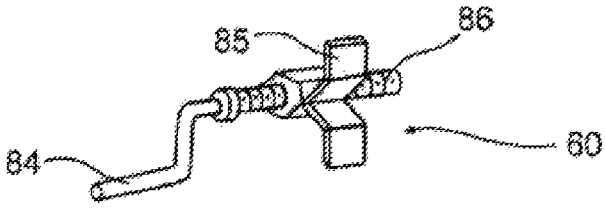
FIG. 4 shows a perspective view of a detail of FIG. 1 showing the elevational control adjustment screw.

Referring to FIG. 4, the elevational control 60 is mounted on the frame 36 (shown in FIG. 1) by the elevational mounting bracket 85, and when the handle 84 is moved, the elevational post 86 contacts the motor plate 54 (shown in FIG. 1) and rotates it about the pinions 56 and 58.

Figure 5:
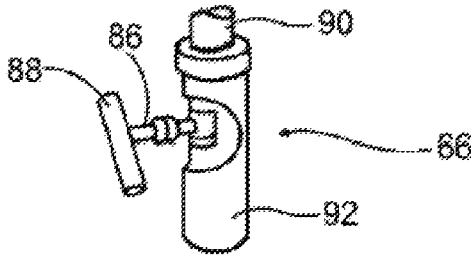
FIG. 5 shows a perspective view of a detail of FIG. 1 showing the traverse lock.

Referring to FIG. 5, the travers lock 66 has a threaded screw means 86 having finger movable wings 88. The threaded screw means contacts a flat on the frame support member 90, which is received by the lower support member 92.

Figure 6:
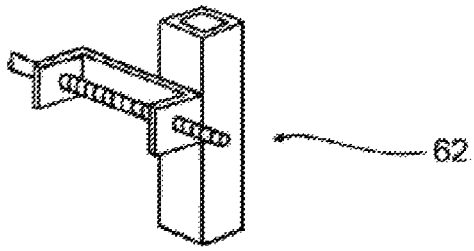
FIG. 6 shows a perspective view of a detail of FIG. 1 showing the motor plate lock.

Referring to FIG. 6, the motor plate lock 62 includes a bolt 94 that is received by the frame 36 to prevent the motor plate from moving. The bolt is moved from the frame to the support and prevents any movement of the frame as the apparatus is moved.

Figure 7:
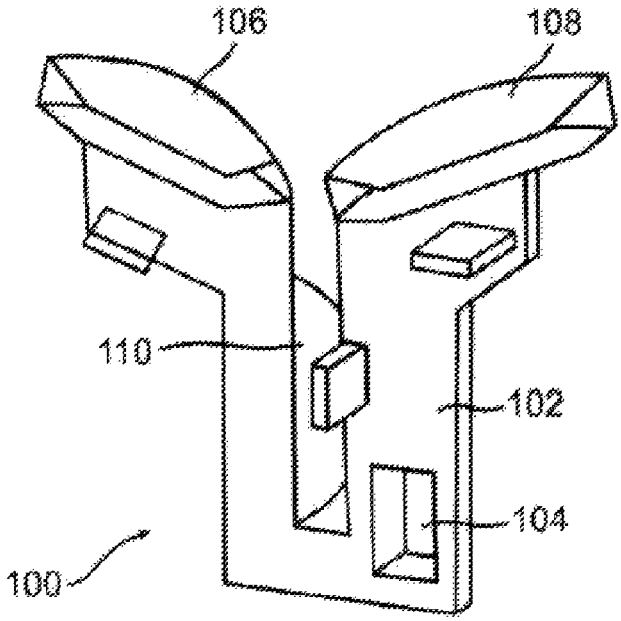
FIG. 7 shows a back perspective view of the preferred guard plate of the present invention.

Referring to FIG. 7, the motor guard 100 that is preferred in the operation of this invention has a ridged shield/motor plate 102 that incorporates a molded box 104 into its side. The wheel guard members 106, 108, and 110 are all integrally molded into the guard shield. The three propelling wheels are mounted on the front of the guard plate. The shielding protects the operator as described herein above from possible contact with the wheels. The use of the single molded guard plate allows for an especially robust construction of the apparatus. This robust construction is needed given the forces and accelerations of the ball that routinely happen with this apparatus.

This invention also provides a method for pitching practice balls. The practice balls are delivered in the practice ball apparatus described above through a chute 18 visible to one in front of the practice ball apparatus to a three-wheel motor driven ball propelling head forming supported by a frame that is pivot able to aim the ball. The balls are presented to the player with any possible spin by controlling the speeds of the three motor powered wheels. People in front of the apparatus are protected from disintegrating wheels by covering at least one of the wheels with a protective guard. The method allows the balls to be presented at any angle an anywhere on a practice field by adjusting an independent horizontal aiming device. Similarly, the method allows the balls to be presented at any angle an anywhere on a practice field by adjusting an independent vertical aiming device.

This invention has been described with reference to specific embodiments and examples thereof. Alterations, modifications, and other changes will invariably suggest themselves to those of ordinary skill in the art. It is intended that the scope of the invention be determined solely by reference to the appended claims, and that the appended claims encompass all such alterations, modifications, and changes.

I claim:

1. An apparatus for pitching practice balls comprising:

a support for holding a ball propelling head at a distance above the ground;

a pivotable frame for the ball propelling head attached to the support;

a mounting plate held by the pivotable frame;

a three-wheel ball propelling head, the head having three wheels, the three wheels arranged to define an: through which a ball is propelled;

one motor for each of the three ball propelling heads, each motor attached to one of the wheels, and each motor mounted on the mounting plate; and a ball presentation frame disposed proximate to the aperture through which a ball to be struck visibly passes before launch by at least the diameter of the ball, the presentation frame displaying a hemisphere of the ball without any obstruction until it reaches the propelling head.

2. The apparatus of claim 1 wherein the apparatus further includes at least one wheel guard plate mounted on the mounting plate behind the ball propelling head to provide protection from the wheels.

3. The apparatus of claim 1 wherein at least one of the motors is a variable speed motor.

4. The apparatus of claim 3 wherein the apparatus further includes a control panel providing support and access to one speed control for each wheel.

5. The apparatus of claim 1 wherein the balls used in practice are stick-hittable balls.

6. The apparatus of claim 5, further comprising an elevational control lever that allows the operator to control the height of the stick-hittable ball presented within a strike zone.

7. The apparatus of claim 1 wherein the apparatus further includes a horizontal control handle that allows the pivotable frame to be secured to the support so it does not move relative to the support during pitching practice.

8. The apparatus of claim 1 wherein the mounting plate is attached within the frame and provides a surface onto which the motors, a ball presentation frame, a front rim guard, a rear rim guard and an elevation control are attached.

9. The apparatus of claim 8 wherein the apparatus includes three guards and the motor plate and the guards are cast of the same piece of metal.

10. The apparatus of claim 1 wherein the apparatus further includes tripod legs to support the apparatus.

11. An apparatus for pitching practice of stick-hittable balls comprising:

a support for a stick-hittable ball propelling head;

a pivotable frame for the stick-hittable ball propelling head attached to the support;

a ball propelling head including three variable speed motor powered wheels, the wheels each attached to a variable speed motor, the three wheels defining an aperture through which substantially one hemisphere of the stick-hittable ball is visible as the ball passes before it is launched, such that the stick-hittable ball is visible from in front of the apparatus without obstruction until it reaches the propelling head, the three variable speed motors attached to a motor plate held within and attached to the pivotable frame;

a control panel attached proximate the motor plate providing access to one speed control for each motor driving a stick-hittable ball propelling head; and at least one rear wheel guard plate behind the ball propelling head, the at least one rear wheel guard plate providing protection from pieces of the wheels if the wheels disintegrate.

12. The apparatus of claim 11 wherein the apparatus has three guard plates and the motor plate and the guard plates are cast from the same piece of metal.

13. The apparatus of claim 11 wherein the apparatus further includes an elevational control lever to allow an operator to control the height of the throwing head with great precision and allow a player to be able to practice different pitches.

14. The apparatus of claim 11 wherein the apparatus further includes a horizontal control handle that allows the frame to be secured before the device is transported.

15. The apparatus of claim 11 wherein the apparatus further includes a concave surface on each of the three wheels to engage the maximum surface of the stick-hittable ball as it passes the three wheels.

16. The apparatus of claim 11 wherein the apparatus further includes tripod legs attachable to the support.

17. The apparatus of claim 11 wherein the apparatus further includes a control panel providing support and access to one speed control for each stick-hittable ball propelling head.

* * * * *